US011280229B2

(12) United States Patent
Guaschino et al.

(10) Patent No.: US 11,280,229 B2
(45) Date of Patent: Mar. 22, 2022

(54) ACTUATION APPARATUS

(71) Applicant: Eaton Intelligent Power Limited, Dublin (IE)

(72) Inventors: Mirko Guaschino, Casale Monferrato (IT); Nicola Andrisani, Cumiana (IT); Jan Kindermann, Prague (CZ); Yuriy Mysak, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 1 day.

(21) Appl. No.: 16/978,719

(22) PCT Filed: Mar. 6, 2019

(86) PCT No.: PCT/EP2019/055588

§ 371 (c)(1),
(2) Date: Sep. 7, 2020

(87) PCT Pub. No.: WO2019/170759

PCT Pub. Date: Sep. 12, 2019

(65) Prior Publication Data

US 2021/0355849 A1 Nov. 18, 2021

(51) Int. Cl.

| | |
|---|---|
| ***F01L 13/00*** | (2006.01) |
| ***F01L 1/46*** | (2006.01) |
| *F01L 1/18* | (2006.01) |

(52) U.S. Cl.

CPC ..... *F01L 13/0005* (2013.01); *F01L 1/46* (2013.01); *F01L 2001/186* (2013.01); *F01L 2013/103* (2013.01); *F01L 2820/032* (2013.01)

(58) Field of Classification Search

CPC ... F01L 2001/186; F01L 1/46; F01L 13/0005; F01L 2013/001; F01L 2013/103; F01L 2820/032

(Continued)

(56) References Cited

U.S. PATENT DOCUMENTS

| | | | |
|---|---|---|---|
| 4,414,935 | A | 11/1983 | Curtis et al. |
| 6,314,928 | B1 | 11/2001 | Baraszu et al. |

(Continued)

FOREIGN PATENT DOCUMENTS

| | | | |
|---|---|---|---|
| CN | 202866918 | U | 4/2013 |
| CN | 106414918 | A | 2/2017 |

(Continued)

*Primary Examiner* — Jorge L Leon, Jr.
(74) *Attorney, Agent, or Firm* — Mei & Mark, LLP

(57) ABSTRACT

An actuation apparatus for actuating one or more components of a respective one or more switchable valve train devices of a first group of switchable valve train devices, and for actuating one or more components of a respective one or more switchable valve train devices of a second group of switchable valve train devices, the actuation apparatus including: a body rotatable by an actuation source about a rotation axis; a first shaft including a first set of one or more levers for actuating the one or more components of the first group of switchable valve train devices, the first shaft including a first element for contacting the body and moveable by the body in use to cause the first shaft to rotate; and a second shaft including a second set of one or more levers for actuating the one or more components of the second group.

20 Claims, 3 Drawing Sheets

(58) Field of Classification Search
USPC ..... 123/90.15
See application file for complete search history.

(56) References Cited

U.S. PATENT DOCUMENTS

| | | | | |
|---|---|---|---|---|
| 6,499,451 | B1 | 12/2002 | Hendriksma et al. | |
| 6,591,798 | B2 * | 7/2003 | Hendriksma ..... | F01L 1/267 123/90.16 |
| 2013/0233265 | A1 | 9/2013 | Zurface et al. | |

FOREIGN PATENT DOCUMENTS

| | | | |
|---|---|---|---|
| GB | 2017820 | A | 10/1979 |
| WO | WO 2013156610 | A1 | 10/2013 |
| WO | WO 2013166029 | A1 | 11/2013 |
| WO | WO 2015141720 | A1 | 9/2015 |
| WO | 2017144706 | A1 | 8/2017 |
| WO | WO 2017202845 | A1 | 11/2017 |

* cited by examiner

ACTUATION APPARATUS

CROSS-REFERENCE TO PRIOR APPLICATIONS

This application is a U.S. National Phase application under 35 U.S.C. § 371 of International Application No. PCT/EP2019/055588, filed on Mar. 6, 2019, and claims benefit to British Patent Application No. GB 1803575.8, filed on Mar. 6, 2018. The International Application was published in English on Sep. 12, 2019 as WO 2019/170759 under PCT Article 21(2).

FIELD

The present invention relates to actuation, and more specifically actuation of components of switchable valve train devices of an internal combustion engine.

BACKGROUND

Internal combustion engines may comprise switchable engine or valve train devices. For example, valve train assemblies may comprise a switchable rocker arm (also referred to as a switchable finger follower) to provide for control of valve actuation by alternating between at least two or more modes of operation (e.g. valve-lift modes). Such rocker arms typically involve multiple bodies, such as an inner arm and an outer arm. These bodies are latched together to provide one mode of operation (e.g. a first valve-lift mode) and are unlatched, and hence can pivot with respect to each other, to provide a second mode of operation (e.g. a second valve-lift mode). Typically, a moveable latch pin is used and actuated and de-actuated to switch between the two modes of operation.

WO 2013/156610 A1 [EATON] discloses such a switchable rocker arm with a moveable latch pin. The default position of the latch pin is unlatched, and it is retained in this position using biasing means. When required, the latch pin is actuated to the latched position using an external actuation mechanism based on a leaf spring. When actuation is required, the leaf spring is controlled to rotate a certain amount so as to engage with a roller of the latch pin, and hence push the latch pin into the latched position. In this way, the mode of operation that the switchable rocker arm provided for is controlled, for example, to provide for internal Exhaust Gas Recirculation. Implementation of actuation of switchable rocker arms can be difficult due to the tight packaging constraints associated with internal combustion engines.

SUMMARY

In an embodiment, the present invention provides an actuation apparatus for actuating one or more components of a respective one or more switchable valve train devices of a first group of switchable valve train devices, and for actuating one or more components of a respective one or more switchable valve train devices of a second group of switchable valve train devices, the actuation apparatus comprising: a body rotatable by an actuation source about a rotation axis; a first shaft comprising a first set of one or more levers configured to actuate the one or more components of the first group of switchable valve train devices, the first shaft comprising a first element configured to contact the body and moveable by the body in use to cause the first shaft to rotate; and a second shaft comprising a second set of one or more levers configured to actuate the one or more components of the second group of switchable valve train devices, the second shaft comprising a second element configured to contact the body and moveable by the body in use to cause the second shaft to rotate, wherein the body has one or more first portions that are offset with respect to one or more second portions of the body, such that control of a rotational orientation of the body about the rotation axis provides control of which of the first portion and the second portion the first element and the second element experience, thereby to provide for control of the actuation of the components on a per switchable valve train group basis.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

In an embodiment, the present invention provides an actuation apparatus as described herein.

In an embodiment, the present invention provides a valve train assembly as described herein.

Further features and advantages of the invention will become apparent from the following description of examples of the invention which is made with reference to the accompanying drawings.

Referring to FIGS. 1 to 4, a valve train assembly 1 of an internal combustion engine comprises an actuation apparatus 2 for actuating one or more components of a respective one or more switchable valve train devices of a first group of switchable valve train devices, and for actuating one or more components of a respective one or more switchable valve train devices of a second group of switchable valve train devices. In this example, each of the switchable valve train devices is a switchable rocker arm, and the component of each switchable rocker arm is a moveable latching arrangement of the rocker arm.

Each switchable rocker arm is arranged to control opening and closing of a valve, for example an exhaust valve, of a cylinder of an overall internal combustion engine. The latching arrangement of each switchable rocker arm comprises a moveable latch pin (represented by arrows C1P1 to C6P2 in FIG. 1) for latching an inner body and an outer body of the rocker arm together.

Figure 1:
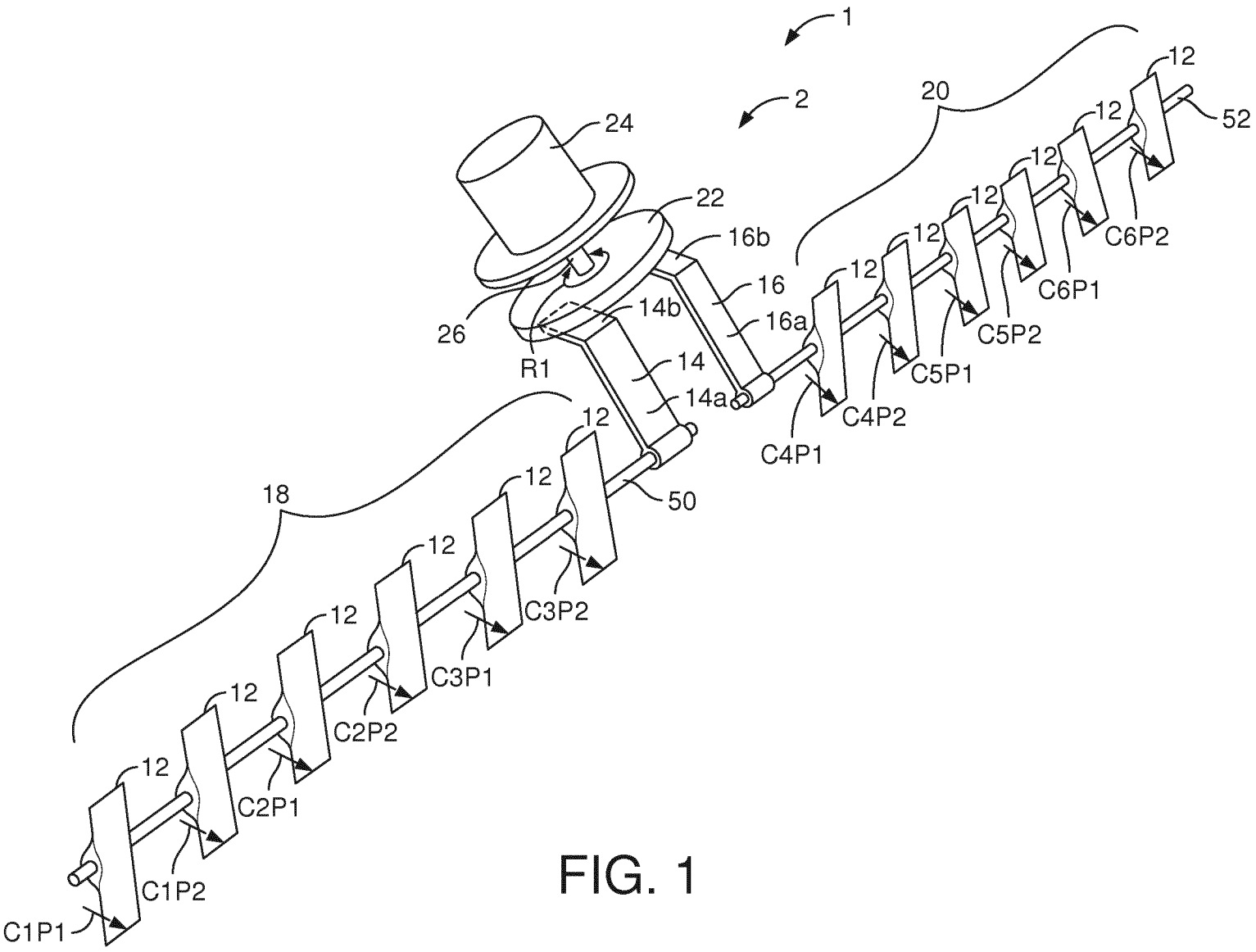
FIG. 1 illustrates schematically a perspective view of a valve train assembly according to an example.

In this example, there are a total of 12 rocker arms (implied by the 12 latch pins C1P1 to C6P2 in FIG. 1). For example, the internal combustion engine may be a six-cylinder engine, and there may be two rocker arms per cylinder. There are 12 latch pins, one per rocker arm. A first latch pin C1P1 may be of a first rocker arm associated with a first cylinder, a second latch pin C1P2 may be of a second rocker arm associated with the first cylinder, a third latch pin C2P1 may be of a first rocker arm associated with a second cylinder, a fourth latch pin C2P2 may be of a second rocker arm associated with the second cylinder, a fifth latch pin C3P1 may be of a first rocker arm associated with a third cylinder, a sixth latch pin C3P2 may be of a second rocker arm associated with the third cylinder, a seventh latch pin C4P1 may be of a first rocker arm associated with a fourth cylinder, a eight latch pin C4P2 may be of a second rocker arm associated with the fourth cylinder, a ninth latch pin C5P1 may be of a first rocker arm associated with a fifth cylinder, a tenth latch pin C5P2 may be of a second rocker arm associated with the fifth cylinder, an eleventh latch pin C6P1 may be of a first rocker arm associated with a sixth cylinder, and a twelfth latch pin C6P2 may be of a second rocker arm associated with the sixth cylinder.

The first group of rocker arms may be those six having the first to sixth latch pins C1P1-C3P2, and the second group of rocker arms may be those six having the seventh to twelfth latch pins C4P1-C6P2.

Switchable rocker arms having moveable latch pins are known per se, see e.g. WO 2013/156610 A1 [EATON].

Each switchable rocker arm may comprise an inner body and an outer body. The inner body and the outer body may be latched together by the moveable latch pin to provide a first mode of operation (e.g. a first valve-lift mode) for example to provide for a first, primary, function, and unlatched, and hence can pivot with respect to each other, to provide a second mode of operation (e.g. a second valve-lift mode) for example to provide for a second, secondary function of the switchable rocker arm. In some examples, the first, primary, function may be a 'normal' valve lift mode, and the second, secondary, function may be valve deactivation of the valve that the rocker arm controls.

Each latch pin may be slidably received in a bore of the outer body of the respective rocker arm. Each latch pin may be moveable between the unlatched position in which the outer body and the inner body are un-latched and hence can pivot with respect to each other about a pivot axis, and the latched position in which the outer body and the inner body are latched together and hence can move or pivot (e.g. about a hydraulic lash adjuster, HLA) as a single.

Each rocker arm may comprise a return spring arrangement for returning the inner body to its rest position after it is has pivoted with respect to the outer body. For example, when the inner body and the outer body of a given rocker arm are unlatched and a lobe of a lift cam engages a roller follower of the inner body, the inner body may pivot relative to the outer body against the return spring arrangement so as to absorb as "lost motion" the lobe of the lift cam and hence no valve event may occur (valve deactivation), whereas when the inner body and the outer body are latched together the lobe of the lift cam engaging the roller follower of the inner body may cause the inner body and outer body to pivot as a single body, which may in turn may cause a valve event to occur (normal operation). Each rocker arm may comprise a return spring arrangement for returning the inner body to its rest position after it is has pivoted with respect to the outer body.

The latching arrangement may comprise a biasing element that urges the latch pin to the unlatched position.

It will be appreciated that in some examples, each rocker arm may be any rocker arm comprising a plurality of bodies that move relative to one another, and which are latched together to provide one mode of operation (valve-lift mode) and are unlatched, and hence can move with respect to each other, to provide a second mode of operation (valve-lift mode). For example, each rocker arm may configured for internal Exhaust Gas Recirculation (iEGR), Cylinder Deactivation (CDA), Early Exhaust Valve Opening (EEVO), or the like applications.

Referring to FIGS. 1 to 4, the actuation apparatus 2 comprises an actuation source 24. The actuation source 24 is a rotary actuator. The actuation source 24 may be or comprise an electric motor. The actuation source 24 may be a brushless direct current (BLDC) electric motor. The actuation apparatus 2 may be referred to as an electro mechanical actuation apparatus 2.

Figure 2:
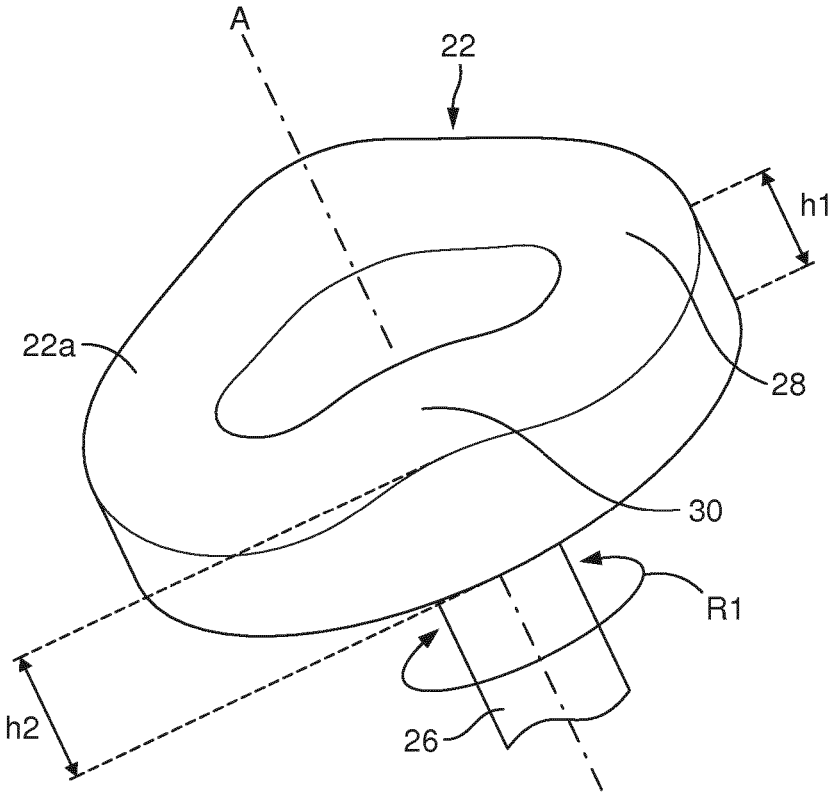
FIG. 2 illustrates schematically a perspective view of body according to an example.
Figure 3:
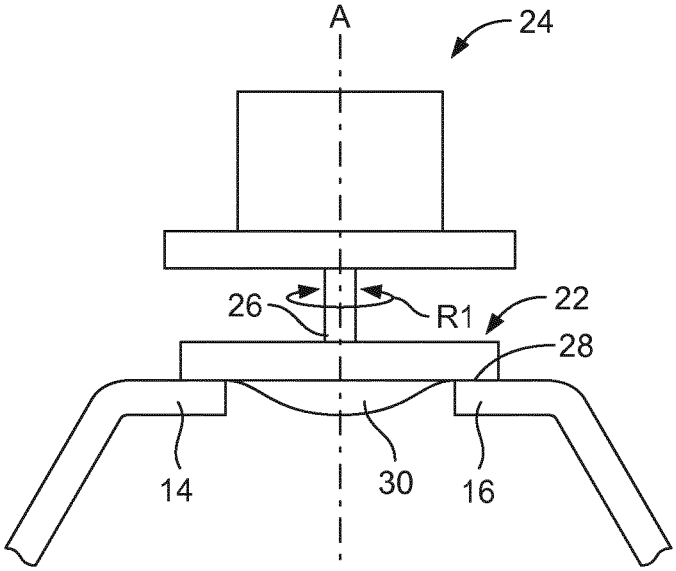
FIG. 3 illustrates schematically a side view of a portion of an actuation apparatus according to an example.
Figure 4:
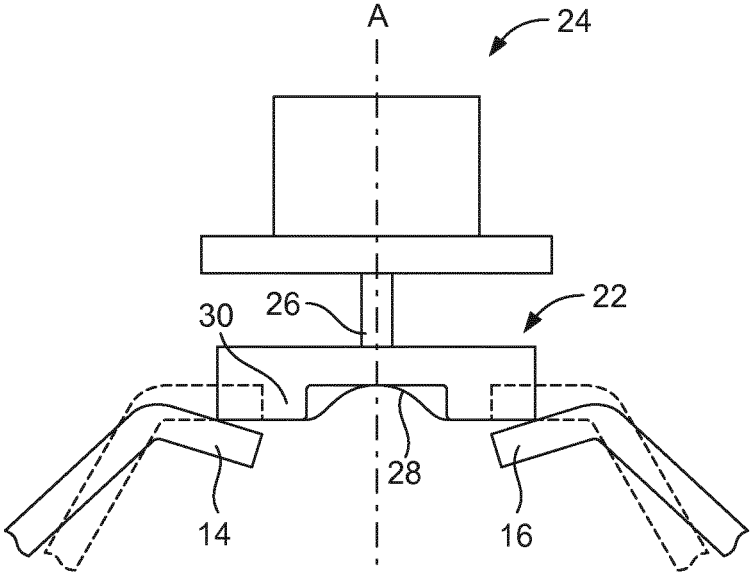
FIG. 4 illustrates schematically a side view of the portion of the example actuation apparatus of FIG. 3, in a different configuration.

The actuation apparatus 2 comprises a body 22 rotatable (see arrow RI) by the actuation source 24 about a rotation axis (see axis A in FIGS. 2 to 4). Specifically, the actuation source 24 comprises a drive shaft 26 that the actuation source 24 causes to rotate about the rotation axis A. The body 22 is fixedly connected to the drive shaft 26 so that rotation of the drive shaft 26 by the actuation source 24 about the rotation axis A causes rotation of the body about the rotation axis A. In this example, the body 22 is a disc 22 (i.e. has a disc like shape) and is rotatable by the actuation source 24 about the principle axis of the disc (axis A).

The actuation apparatus 2 comprises a first shaft 50. The first shaft 50 is generally elongate and extends substantially perpendicularly to the rotation axis A. The first shaft 50 comprises a first set 18 of one or more levers 12 for actuating the latching arrangements of the first group of rocker arms (as illustrated, the first set 18 has six levers 12, one each for contacting and actuating the first to sixth latch pins C1P1-C3P2 of the first group of rocker arms. The first shaft 50 comprises a first element 14 arranged to contact the body 22. The first element 14 is moveable by the body 22 in use to cause the first shaft 50 to rotate (and hence the first set 18 of levers 12 to pivot about an axis of the first shaft 50 between a first position for actuating the latching arrangements of the first group of rocker arms and a second position for de-actuating the latching arrangements of the first group of rocker arms). The first element 14 comprises a member 14*a* fixedly connected to the first shaft 50 and extending radially from the first shaft 50, and a contact portion 14*b* extending from the member so as to contact the body 22. The first shaft 50 may comprise a torsional spring or other biasing means to urge the first element into contact with the body 22.

The actuation apparatus 2 comprises a second shaft 52. The second shaft 52 is generally elongate and extends substantially perpendicularly to the rotation axis A. The second shaft 52 extends substantially co-linearly to the first shaft 50. The first shaft 50 and the second shaft 52 are rotatable independently of one another. The second shaft 52 comprises a second set 20 of one or more levers 12 for actuating the latching arrangements of the second group of rocker arms (as illustrated, the second set 20 has six levers 12, one each for contacting and actuating the seventh to twelfth latch pins C4P1-C6P2 of the second group of rocker arms. Each lever 12 extends radially from the second shaft 52. The second shaft 52 comprises a second element 16 arranged to contact the body 22. The second element 16 is moveable by the body 22 in use to cause the second shaft 52 to rotate (and hence the second set 20 of levers 12 to pivot about an axis of the shaft between a first position for actuating the latching arrangements of the second group of rocker arms and a second position for de-actuating the latching arrangements of the second group of rocker arms). The second element 16 comprises a member 16*a* fixedly connected to the second shaft 52 and extending radially from the second shaft 52, and a contact portion 16*b* extending from the member so as to contact the body 22. The second shaft 52 may comprise a torsional spring or other biasing means to urge the second element 16 into contact with the body 22

In overview, and as perhaps best seen in FIGS. 2 to 4, the body 22 has one or more first portions 28 that are offset with respect to one or more second portions 30 of the body, such that control of the rotational orientation of the body 22 about the rotation axis A provides control of which of the first portion 28 and the second portion 30 the first element 14 and the second element 16 experience, thereby to provide for control of the actuation of the latching arrangements on a per group basis.

More specifically, as perhaps best seen in FIG. 2, the one or more first portions 28 are offset in a direction parallel to the rotation axis A with respect to the one or more second portions 30. Specifically, the one or more first portions 28 are closer, in a direction parallel to the rotation axis A, to the shafts 50, 52, and are further away, in a direction parallel to the rotation axis A, to the actuation source 24, than are the one or more second portions 30. The first 28 and second 30 portions are arranged sequentially along a substantially circular path concentric with the rotation axis A.

In this example, the body 22 has a disc like shape. The body 22 defines a surface 22*a* against which the first element 14 and the second element 16 are arranged to engage. The surface 22*a* is a major surface of the body/disc 22. The one or more first portions 28 and the one or more second portions 30 of the body 22 are portions of the surface 22*a* of the body 22. That is the one or more first portions 28 of the surface 22*a* of the body 22 are offset in a direction parallel to the rotation axis A with respect to the one or more second portions 30 of the surface 22*a* of the body 22.

The surface 22*a* curves between adjacent ones of the first portion 28 and the second portion 30. That is, the transition between the first 28 and second portions 30 on the surface 22*a* along a substantially circular path concentric with the rotation axis is smooth.

In this example, the offset of the one or more first portions 28 with respect to the one or more second portions 30 is provided by the body 22 having a different thickness h1, h2 at the one or more first portions 28 than at the one or more second portions 30. Specifically, a major surface of the body/disc 22 opposite to the surface 22*a* of the disc comprising the first 28 and second 30 portions is substantially flat and perpendicular to the rotation axis A. The thickness h1 of the body/disc 22 at the first portion 28 is less than the thickness h2 of the body/disc 22 at the second portion 30.

As mentioned above, the actuation apparatus 2 is arranged such that control of the rotational orientation of the body 22 about the rotation axis A provides control of which of the first portion 28 and the second portion 30 the first element 14 and the second element 16 experience, thereby to provide for control of the actuation of the latching arrangements on a per group basis, i.e. on a per rocker arm group basis. The actuation of the latching arrangements of the first group and the second group of rocker arms may be independent of one another. This may provide for more flexible control.

More specifically, the actuation source may be controlled by a control unit. When actuation of the latching arrangements of both the first group and the second group of rocker arms is desired (e.g. when it is desired that all twelve of the latch pins C1P1-C6P2 are to be moved to the latched position so that all twelve of the rocker arms provide for a first, primary, function or valve lift mode, for example) the control unit may control the actuation source to cause the body 22 to be rotationally orientated about the rotation axis A such that both the first element 14 and the second element 16 contact or engage with one or more of the first portions 28 of the body 22. This is the situation illustrated schematically in FIG. 3. Referring to FIG. 1, in this case, both the first element 14 and the second element 16 will be pivoted relatively upwards in the sense of FIG. 1 towards the actuation source 24, which will cause both the first shaft 50 and the second shaft 52, respectively, to be rotated relatively clockwise in the sense of FIG. 1, which will cause both the first set of levers 18 and the second set of levers 20, respectively, to be positioned for actuation of the latching arrangements of the first group and the second group of rocker arms, respectively (e.g. pivoted so as to apply a force to the latch pins C1P1-C6P2 to cause all the latch pins to move from the unlatched position to the latched position, for example).

When de-actuation of the latching arrangements of both the first group and the second group of rocker arms is desired (e.g. when it is desired that all twelve of the latch pins C1P1-C6P2 are to be moved to the unlatched position so that all twelve of the rocker arms provide for a second, secondary, function or valve lift mode, for example) the control unit may control the actuation source to cause the body 22 to be rotationally orientated about the rotation axis A such that both the first element 14 and the second element 16 contact or engage with one or more of the second portions 30 of the body 22. This is the situation illustrated schematically in FIG. 4. Referring to FIG. 1, in this case, both the first element 14 and the second element 16 will be pushed downwards in the sense of FIG. 1 to be pivoted away from the actuation source 24, which will cause both the first shaft 50 and the second shaft 52, respectively, to be rotated relatively anticlockwise in the sense of FIG. 1, which will cause both the first set of levers 18 and the second set of levers 20, respectively, to be positioned for de actuation of the latching arrangements of the first group and the second group of rocker arms, respectively (e.g. pivoted so as to apply substantially no force to the latch pins C1P1-C6P2 to allow all the latch pins to move from the latched position to the unlatched position under the force of the respective biasing elements of the respective latching arrangements, for example).

When actuation of the latching arrangements of the first group of rocker arms, and de-actuation of the latching arrangements of the second group of rocker arms, is desired (e.g. when it is desired that the first to sixth latch pins C1P1-C3P2 are to be in the latched position so that the first group of rocker arms provide for the first, primary, function, and that the seventh to twelfth latch pins C4P1-C6P2 are to be in the unlatched position so that the second group of rocker arms provide for the second, secondary, function, for example) the control unit may control the actuation source to cause the body 22 to be rotationally orientated about the rotation axis A such that the first element 14 contacts or engages with one of the first portions 18 and the second element 16 contacts or engages with one of the second portions 30 of the body 22. As a result, the first set of levers 18 will be positioned for actuation of the latching arrangements of the first group of rocker arms and the second set 20 of levers will be positioned for de-actuation of the latching arrangements of the second group of rocker arms.

Conversely, when actuation of the latching arrangements of the second group of rocker arms, and de-actuation of the latching arrangements of the first group of rocker arms, is desired (e.g. when it is desired that the first to sixth latch pins C1P1-C3P2 are to be in the unlatched position so that the first group of rocker arms provide for the second, secondary, function, and that the seventh to twelfth latch pins C4P1-

C6P2 are to be in the latched position so that the second group of rocker arms provide for the first, primary, function, for example) the control unit may control the actuation source to cause the body 22 to be rotationally orientated about the rotation axis A such that the first element 14 contacts or engages with one of the second portions 30 of the body 22 and the second element 16 contacts or engages with one of the first portions 28 of the body 22. As a result, the first set of levers 18 will be positioned for de-actuation of the latching arrangements of the first group of rocker arms and the second set 20 of levers will be positioned for actuation of the latching arrangements of the second group of rocker arms.

It will be appreciated that there may be several configurations of the first 14 and second 16 elements, as well as of the first 28 and second 30 portions of the body 22, to provide for the above functionality. As one example, the first element 14 may contact the surface 22*a* of the body 22 on a substantially opposite side of the rotation axis A to where the second element 16 contacts the surface 22*a* of the body 22. In this case, the surface 22*a* of the body 22 may comprise, for example, two first portions 28 on substantially opposite sides of the rotational axis A. The body 22 may be rotationally orientated so that the first element 14 engages with one of the first portions 28 and the second element 16 engages with the other of the first portions 28, and hence as described above, actuation of latching arrangements of both the first group and the second group of rocker arms may be achieved. The surface 22*a* of the body 22 may comprise, for example, two second portions 30 on substantially opposite sides of the rotational axis A. For example, a line joining the two first portions 28 may be perpendicular to a line joining the two second portions 30. That is, a quarter turn of the body may take the first 14 and second elements 16 from being engaged with the two first portions 28 to being engaged with the two second portions 30. The body 22 may therefore be rotationally orientated so that the first element 14 engages with one of the second portions 30 and the second element 16 engages with the other of the second portions 30, and hence as described above, de-actuation of latching arrangements of both the first group and the second group of rocker arms may be achieved. The body 22 may comprise a further first portion 28 and a further second portion 30 on substantially opposite sides of the rotational axis A from one another. For example, a line joining the two first portions 28 may make an angle of substantially 45 degrees to a line joining the further first portion 28 and the further second portion 30. That is, an eighth turn of the body may take the first 14 and second elements 16 from being engaged with the two first portions 28 (or the two second portions 30) to being engaged with the further first portion 28 and the further second portion 30, respectively, or vice versa. The body 22 may therefore be rotationally orientated so that one of the first element 14 and the second element 16 engages with the further first portion 28 and the other of the first element 14 and the second element 16 engages with the further second portion 30, and hence as described above, de-actuation of the latching arrangements of one of the first group and the second group, but actuation of the other of the first group and the second group, may be achieved.

The above example configuration need not necessarily be used to provide the above functionality it will be appreciated that other configurations may be used. For example, the first element 14 and the second element 16 need not necessarily be directly opposite one another and may be placed, for example, on a similar segment of the body 22. In this case the functionality described above may be provided, for example, using only one first portion 28 and one second portion 30.

Further, it will be appreciated that although in the above configuration, contact of the first 14 and second 16 elements with a first portion 28 provided for movement of the latch pins from the unlatched position to the latched position, and, contact of the first 14 and second 16 elements with a second portion 30 provided for movement of the latch pins from the latched position to the unlatched position, it will be readily appreciated that this need not necessarily be the case and that in other examples the actuation may comprise movement the latch pin from one of an unlatched position in which the first body and the second body are unlatched so that the first body and the second body are moveable relative to one another so that the switchable rocker arm is configured for a first mode of operation, and a latched position in which the first body and the second body are latched together so that the switchable rocker arm is configured for a second mode of operation, to the other of the unlatched position and the latched position.

The actuation apparatus 2 may be installed in, for example fixedly mounted on or connected to, a cylinder head of the internal combustion engine. The actuation apparatus 2 may allow efficient packaging of the per-rocker-arm-group control functionality to be implemented in the internal combustion engine. For example, the actuation apparatus 2 allows for per-rocker-arm-group control to be controlled by a single actuation source, for example a single rotary actuation source. The configuration of the actuation apparatus 2 may allow for packaging constraints to be effectively and efficiently met. For example, the configuration of the actuation apparatus 2 allows the actuation apparatus 2 to be installed into the cylinder head (above the valve train assembly) whilst still efficiently and effectively providing the per-rocker-arm-group control functionality. The actuation apparatus 2 allows for the activation of the secondary functions (e.g. valve deactivation) of the switchable rocker arms (also known as switchable finger followers) without the actuation source acting directly on the latch pins of the switchable rocker arms. Since the actuation apparatus may provide control of the functionality of the rocker arms (e.g. normal valve lift or valve deactivation) on a per rocker arm group basis, then the actuation apparatus 2 may provide control of the activation and/or deactivation of cylinders of the internal combustion engine on a per cylinder group basis (e.g. in the example of a six cylinder engine then a first group may comprise the first to third cylinders and the second group may comprise the fourth to sixth cylinders) or for example, on a per cylinder basis (e.g. if the first group consists of one cylinder and the second group consists of another cylinder). Hence the actuation apparatus 2 may allow for improved control of how many or what proportion of the engine's cylinders are active at any given time, and hence may allow for improved flexibility in the operation of the engine. Although a six-cylinder engine is referred to above, it will be appreciated that the actuation apparatus 2 may be implemented for engines having a different number of cylinders.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SIGNS LIST

A axis
R1 rotation
1 valve train assembly 2 actuation apparatus
C1P1-C6P2 latch pins
12 levers
14, 16 element
14*a*, 16*a* member
16*b*, 16*b* contact portion
18, 20 set of levers 22 body
22*a* surface
24 actuation source 26 drive shaft
28 first portion 30 second portion h1, h2 thickness

The invention claimed is:

1. An actuation apparatus for actuating a first group of one or more switchable valve train devices, and for actuating a second group of one or more switchable valve train devices, the actuation apparatus comprising:

a body configured to rotate about a rotation axis via an actuation source;

a first shaft comprising a first set of one or more levers configured to respectively actuate the first group of one or more switchable valve train devices, and a first element configured to contact the body such that the first shaft rotates via the first element in accordance with the rotation of the body; and a second shaft comprising a second set of one or more levers configured to respectively actuate the second group of one or more switchable valve train devices, and a second element configured to contact the body such that the second shaft rotates via the second element in accordance with the rotation of the body, wherein the body contacts the first and second elements via one or more first portions and one or more second portions, the one or more first portions being offset from the one or more second portions, and wherein the actuation of the first group of one or more switchable valve train devices is controlled based on whether the first element is in contact with the one or more first portions or the one or more second portions, and the actuation of the second group of one or more switchable valve train devices is controlled based on whether the second element is in contact with the one or more first portions or the one or more second portions.

2. The actuation apparatus according to claim 1, wherein the one or more first portions are offset from the one or more second portions in an axial direction of the body.

3. The actuation apparatus according to claim 1, wherein the body defines a surface against which the first element and the second element are configured to contact, and wherein the surface comprises the one or more first portions and the one or more second portions.

4. The actuation apparatus according to claim 3, wherein the one or more first portions alternate with the one or more second portions along the surface via curved transitions of the surface.

5. The actuation apparatus according to claim 1, wherein the offset is provided by the body having a different thickness at the one or more first portions than at the one or more second portions.

6. The actuation apparatus according to claim 1, wherein:

the first and second sets of one or more levers are respectively positioned for actuation of the first and second groups of one or more switchable valve train devices when the body is rotated such that the first and second elements engage with the one or more first portions, the first and second sets of one or more levers are respectively positioned for de-actuation of the first and second groups of one or more switchable valve train devices when the body is rotated such that the first and second elements engage with the one or more second portions, the first set of one or more levers is positioned for actuation of the first group of one or more switchable valve train devices, and the second set of one or more levers is positioned for de-actuation of the second group of one or more switchable valve train devices, when the body is rotated such that the first element engages with the one or more first portions and the second element engages with the one or more second portions, and the first set of one or more levers is positioned for de-actuation of the first group of one or more switchable valve train devices, and the second set of one or more levers is positioned for actuation of the second group of one or more switchable valve train devices, when the body is rotated such that the first element engages with the one or more second portions and the second element engages with the one or more first portions.

7. The actuation apparatus according to claim 1, wherein the first element and the second element each comprise a member extending radially from the first shaft and the second shaft, respectively.

8. The actuation apparatus according to claim 1, wherein the actuation source comprises a rotary actuator.

9. The actuation apparatus according to claim 1, wherein the actuation source comprises an electric motor.

10. A valve train assembly, comprising:

the actuation apparatus according to claim 1.

11. The valve train assembly according to claim 10, wherein each switchable valve train device is a switchable rocker arm comprising a first body, a second body, and a latching arrangement including a moveable latch pin configured to latch the first body and the second body together.

12. The valve train assembly according to claim 11, wherein each switchable rocker arm is configured to be alternately switched between a first mode of operation in which the latch pin is moved to an unlatched position such that relative movement between the first body and the second body is enabled, and a second mode of operation in which the latch pin is moved to a latched position such that the first body and the second body are latched together.

13. The valve train assembly according to claim 12, wherein the first mode of operation provides for valve deactivation.

14. The valve train assembly according to claim 12, wherein each latching arrangement further includes a biasing element configured to urge the latch pin from the latched position to the unlatched position.

15. An actuation apparatus for actuating a first group of one or more switchable rocker arms, and for actuating a second group of one or more switchable rocker arms, the actuation apparatus comprising:

a rotary actuator;

a body connected to the rotary actuator, the body configured to rotate about a rotation axis;

a first shaft comprising a first set of one or more levers configured to respectively actuate the first group of one or more switchable rocker arms, and a first element configured to contact the body such that the first shaft rotates via the first element in accordance with the rotation of the body; and a second shaft comprising a second set of one or more levers configured to respectively actuate the second group of one or more switchable rocker arms, and a second element configured to contact the body such that the second shaft rotates via the second element in accordance with the rotation of the body, wherein the body contacts the first and second elements via one or more first portions and one or more second portions, the one or more first portions being offset from the one or more second portions, and wherein the actuation of the first group of one or more switchable rocker arms is controlled based on whether the first element is in contact with the one or more first portions or the one or more second portions, and the actuation of the second group of one or more switchable rocker arms is controlled based on whether the second element is in contact with the one or more first portions or the one or more second portions.

16. The actuation apparatus of claim 15, wherein the body comprises a disc like shape.

17. The actuation apparatus of claim 15, wherein each switchable rocker arm comprises a first body, a second body, and a latching arrangement including a moveable latch pin configured to latch the first body and the second body together.

18. The actuation apparatus of claim 17, wherein each latching arrangement further includes a biasing element configured to urge the latch pin towards one of a latched position and an unlatched position.

19. The actuation apparatus of claim 17, wherein the first set of one or more levers is configured to respectively actuate each latching arrangement of the first group of one or more switchable rocker arms from a latched position to an unlatched position.

20. The actuation apparatus of claim 17, wherein the first set of one or more levers is configured to respectively actuate each latching arrangement of the first group of one or more switchable rocker arms from an unlatched position to a latched position.

* * * * *